US008129081B2

(12) United States Patent
Gilmartin et al.

(10) Patent No.: US 8,129,081 B2
(45) Date of Patent: Mar. 6, 2012

(54) PHOTOCONDUCTIVE IMAGING MEMBERS

(75) Inventors: Brian Gilmartin, Williamsville, NY (US); Liang-Bih Lin, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 675 days.

(21) Appl. No.: 12/212,488

(22) Filed: Sep. 17, 2008

(65) Prior Publication Data

US 2010/0068639 A1 Mar. 18, 2010

(51) Int. Cl.
*G03G 5/047* (2006.01)

(52) U.S. Cl. ..... 430/57.1; 430/63; 430/65; 430/66; 430/83

(58) Field of Classification Search ..... 430/57.1, 430/63, 65, 66, 83
See application file for complete search history.

(56) References Cited

U.S. PATENT DOCUMENTS

2007/0020540 A1* 1/2007 Qi et al. ..... 430/58.2
2007/0141490 A1* 6/2007 Wu et al. ..... 430/59.1

* cited by examiner

*Primary Examiner* — Hoa Le
(74) *Attorney, Agent, or Firm* — MH2 Technology Law Group LLP

(57) ABSTRACT

Exemplary embodiments provide charge generating layers and electrographic imaging members containing the charge generating layers. In various embodiments, an imaging member can be a multilayered photoconductive imaging member with a charge generating layer including, for example, a photogenerating pigment, such as a metal phthalocyanine; a dopant material, such as a multiple halide compound dopant and/or an ether dopant; and a binder or polymer. The imaging members can exhibit high photosensitivity, low residual potential ($V_{erase}$), and excellent cyclic/environmental stability and can be used as photoreceptors, photosensitive members, and the like, in a machine of copy, printer, fax, scan, multifunction machines, and the like.

18 Claims, 2 Drawing Sheets

PHOTOCONDUCTIVE IMAGING MEMBERS

DESCRIPTION OF THE INVENTION

1. Field of the Invention

This invention relates generally to imaging members and, more particularly, to charge generating layers of photoconductive imaging members that include dopant materials to reduce residual potential of the imaging members.

2. Background of the Invention

In the art of electrophotography, a photoreceptor, imaging member, or the like, including a photoconductive insulating layer on a conductive layer, is imaged by first uniformly electrostatically charging the surface of the photoconductive insulating layer. The photoreceptor is then exposed to a pattern of activating electromagnetic radiation such as light, which selectively dissipates the charge in the illuminated areas of the photoconductive insulating layer while leaving behind an electrostatic latent image in the non-illuminated areas. This electrostatic latent image may then be developed to form a visible image by depositing finely divided electroscopic toner particles on the surface of the photoconductive insulating layer. The resulting visible toner image can be transferred to a suitable receiving member such as paper. This imaging process may be repeated many times with reusable photoconductive insulating layers.

Generally, photoreceptors require an acceptable photosensitivity, desired low residual potential ($V_{erase}$, i.e., the surface potential after subjecting imaging members to erase lamp exposure), desired low surface potential at high exposure ($V_L$) and less dark decay indicating a low surface potential while the photoreceptor is in the dark. The photogenerating pigments in the photoconductive insulating layer of photoreceptors often exhibit acceptable photosensitivity, which can be described as the slope of the initial photodischarge curve plotted as surface potential vs. exposure, or the amount of exposure required to discharge the surface potential of the imaging member of about ½ or ⅞ of the initial voltage. For example, conventional photogenerating pigment such as titanyl phthalocyanine (TiOPc) provides exceptional photosensitivity. Currently, TiOPc is one of the highest photosensitive pigments used in photoreceptor technology. The residual potential ($V_{erase}$) and surface potential at high exposure ($V_L$) of the pigment, however, can be undesirably high and still require some attention. This is because high surface potential can cause compressed (insufficient) development field, beads carry out, low print density, and xerographic development issues.

Thus, there is a need to overcome these and other problems of the prior art and to provide photoconductive imaging members having decreased residual potential ($V_{erase}$), surface potential at high exposure ($V_L$) and/or dark decay of the imaging members.

SUMMARY OF THE INVENTION

According to various embodiments, the present teachings include an imaging member. The image member can include a substrate; an undercoat layer disposed over the substrate; and a charge generating layer disposed over the undercoat layer. The charge generating layer can include a halide-containing dopant having at least one charge transport layer disposed thereover.

According to various embodiments, the present teachings also include an imaging member. The imaging member can include a substrate; an undercoat layer including metal oxide disposed on the substrate; a charge generating layer including a halogen-containing dopant and a phthalocyanine photogenerating pigment disposed on the undercoat layer; at least one charge transport layer disposed on the charge generation layer; and an optional overcoat layer disposed on the at least one charge transport layer.

According to various embodiments, the present teachings further include an image forming apparatus for forming images on a recording medium. The apparatus can include a photoreceptor member having a charge retentive surface to receive an electrostatic latent image thereon. For example, the photoreceptor member can include a metal or metallized substrate, an undercoat layer disposed on the metal or metallized substrate, a charge generating layer including a halide-containing dopant in a phthalocyanine photogenerating pigment disposed on the undercoat layer, at least one charge transport layer disposed on the charge generation layer, and an optional overcoat layer disposed on the at least one charge transport layer. The apparatus can also include a development member to apply a developer material to the charge-retentive surface of the photoreceptor member to develop the electrostatic latent image to form a developed image on the charge-retentive surface; a transfer member for transferring the developed image from the charge-retentive surface to another member or a copy substrate; and a fusing member to fuse the developed image to the copy substrate.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention.

DESCRIPTION OF THE EMBODIMENTS

Figure 1:
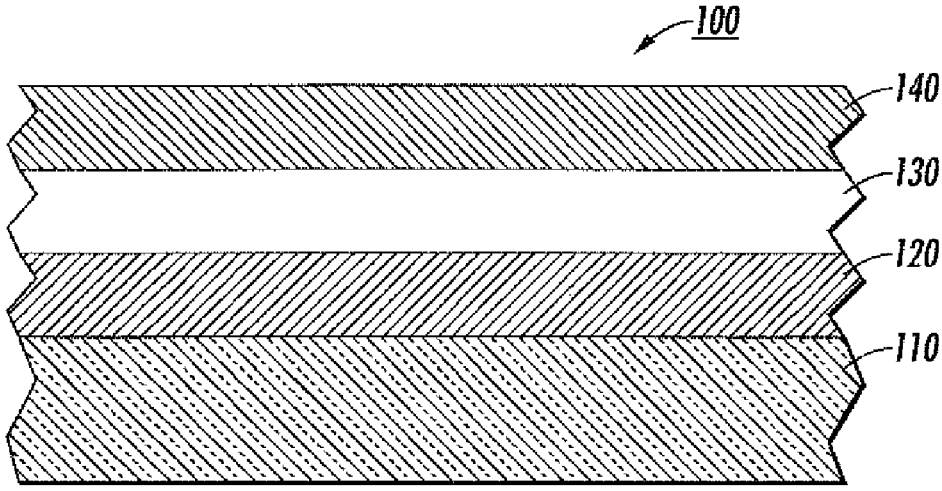
FIG. 1 depicts an exemplary imaging member in accordance with the present teachings.

Reference will now be made in detail to the present embodiments (exemplary embodiments) of the invention, an example of which is illustrated in the accompanying drawings. Wherever possible, the same reference numbers will be used throughout the drawings to refer to the same or like parts. In the following description, reference is made to the accompanying drawings that form a part thereof, and in which is shown by way of illustration specific exemplary embodiments in which the invention may be practiced. These embodiments are described in sufficient detail to enable those skilled in the art to practice the invention and it is to be understood that other embodiments may be utilized and that changes may be made without departing from the scope of the invention. The following description is, therefore, merely exemplary.

While the invention has been illustrated with respect to one or more implementations, alterations and/or modifications can be made to the illustrated examples without departing from the spirit and scope of the appended claims. In addition, while a particular feature of the invention may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." As used herein, the term "one or more of" with respect to a listing of items such as, for example, A and B, means A alone, B alone, or A and B. The term "at least one of" is used to mean one or more of the listed items can be selected.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume values as defined earlier plus negative values, e.g. −1, −1.2, −1.89, −2, −2.5, −3, −10, −20, −30, etc.

Exemplary embodiments provide charge generating layers and electrographic imaging members containing the charge generating layers. In various embodiments, the imaging members can be multilayered photoconductive imaging members with a charge generating layer including, for example, a photogenerating pigment, such as a metal phthalocyanine; a dopant material, such as a halogen-containing dopant, an ether-type dopant, and/or a diiodo-type compound; and a binder or polymer. The imaging members disclosed herein can exhibit high photosensitivity, low residual potential ($V_{erase}$), and excellent cyclic/environmental stability and can be used as photoreceptors, photosensitive members, and the like, in a machine of copy, printer, fax, scan, multifunction machines, and the like.

FIG. 1 depicts an exemplary imaging member 100 containing a charge generating layer (CGL) in accordance with the present teachings. It should be readily apparent to one of ordinary skill in the art that the member 100 depicted in FIG. 1 represents a generalized schematic illustration and that other components/layers can be added or existing components/layers can be removed or modified.

In the exemplary embodiment as shown in FIG. 1, the imaging member 100 can include a supporting substrate 110, an undercoat layer (UCL) 120, a charge generating layer (CGL) 130, a charge transport layer (CTL) 140, and, in embodiments, an optional overcoat layer (OCL) (not illustrated). The charge generating layer 130 can be situated between the undercoat layer 120 and the charge transport layer 140. The undercoat layer 120 can be disposed in contact with the supporting substrate 110 and situated between the supporting substrate 110 and the charge generating layer 130. The optional overcoat layer can be deposited on top of the charge transport layer 140.

During the exposure and development stages of xerographic cycles, electrons can be trapped mainly at or near the interface between charge generating layer (CGL) and undercoating layer (UCL) and holes can be mainly at or near the interface between charge generating layer (CGL) and charge transport layer (CTL). The trapped charges can be immobile or can migrate according to the electric field during the image transfer stage, where the positive field can allow electrons to move from the interface of CGL/UCL (e.g., 130/120) toward the interface of CTL/CGL (e.g., 140/130) or the holes from CTL/CGL (e.g., 140/130) interface to CGL/UCL (e.g., 130/120) interface and can become deep traps that are no longer mobile. In some cases, these deep traps can cause subsequent development issues leading to print defects.

The charge generating layer 130 used in the multilayered imaging member 100 can be capable of photogenerating holes and injecting the photogenerated holes into the charge transport layer 140. The charge generating layer 130 can include one or more of, e.g., a photogenerating pigment, a dopant material, and a binder material. The photogenerating pigment and/or the dopant material can be dispersed in a film forming binder, such as a polymeric binder to form a continuous, homogenous charge generating section in the charge generating layer 130.

In various embodiments, the photogenerating layer can contain known photogenerating pigments, such as metal phthalocyanines, metal free phthalocyanines, titanyl phthalocyanines (TiOPc), hydroxygallium phthalocyanines (HOGaPc), chlorogallium phthalocyanine (ClGaPc), perylenes such as bis(benzimidazo)perylene, vanadyl phthalocyanines, and the like; inorganic components, such as selenium (e.g., trigonal selenium), and the like; and mixtures and combinations thereof.

As disclosed herein, the charge generating layer 130 can further include one or more dopants with the structure given in formula I.

Formula I

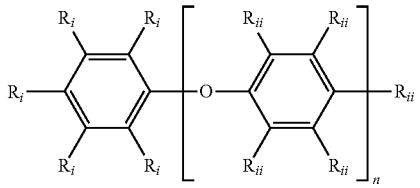

Wherein n is between 1 and 3, and $R_i$ and $R_{ii}$ are independently selected from the group consisting of at least one of hydrogen, alkyl, alkenyl, alkoxy, halogen, and the derivatives thereof. The dopants can include, but are not limited to, a halide-containing compound, e.g., a halide-containing compound, such as 1,2-Bis(p-iodophenyl)ether (IPE), 1,3,5-tribromo-2-(4-bromophenoxy)benzene or 1,4-Bis(bromophenoxy)benzene.

The photogenerating pigment and/or the dopant materials can be dispersed in the binder material similar to the binders selected for the charge transport layer 140, or alternatively no binder material can be used. The binder material can be selected from a number of known polymers, such as, for example, poly(vinyl butylene), poly(vinyl carbazole), poly (vinyl butyral), polyesters, polycarbonates, poly(vinyl chloride), polyacrylates and methacrylates, copolymers of vinyl chloride and vinyl acetate, phenoxy resins, polyurethanes, poly(vinyl alcohol), polyacrylonitrile, polystyrene, and the like.

When the photogenerating pigment and/or the dopants dispersed in the binder material, a dispersion solvent can be used. Examples of the solvents that can be selected for use as coating solvents for the charge generating layers 130 can include ketones, alcohols, aromatic hydrocarbons, halogenated aliphatic hydrocarbons, ethers, amines, amides, esters, and the like. Specific examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the likes.

The coating dispersion, including one or more of the photogenerating pigment, the dopant material and the binder material, can be prepared by known methods. The charge generating layer can then be formed by applying the coating dispersion onto an underlying layer, e.g., the substrate 110 or the undercoat layer 120, by use of, e.g., a spray coater, dip coater, extrusion coater, roller coater, wire-bar coater, slot coater, slot die coater, doctor blade coater, gravure coater, and the like. The coated layer can then be dried at a temperature for a suitable period of time under stationary conditions or in an air flow. The coating can have a final coating thickness for the charge generating layer 130 after drying.

The final coating thickness of the charge generating layer 130 can range from about 0.05 μm to 10 μm. In an additional example, the thickness of the charge generating layer 130 can be from about 0.1 μm to about 2 μm after being dried, for example, ambiently or at a temperature of about 30° C. to about 160° C. for about 1 minute to about 20 minutes.

In various embodiments, the charge generating layer 130 can include the dopant material, such as IPE, in an effective amount of about 0.1 percent to about 75 percent by weight of the charge generating layer 130; the photogenerating pigment, such as titanyl phthalocyanines (TiOPc), in an amount of about 5 percent to about 95 percent by weight of the charge generating layer 130; and a binder material, such as polyvinyl chloride, in an amount of about 5 percent to about 95 percent by weight of the charge generating layer 130.

By the addition of the dopant material into the charge generating layer 130, the residual potential and the dark decay of the imaging member 100 can be decreased. For example, the charge generating layer can include a dihalogen ether IPE dopant and a titanyl phthalocyanine (TiOPc) photocharging pigment to significantly decrease the residual potential and surface potential at high exposure ($V_L$), and/or dark decay of the resulting imaging member, while maintaining the cyclic stability and desired photosensitivity of the pigment. While not intending to be bound by any particular theory, it is believed that, in the packing of the IPE-doped pigment, the diiodo compound dopant can coordinate two titanium atoms from adjacent phthalocyanine complexes to create a network path and facilitate better electron-hole dissociation of the resulting charge generating layer and prevent deep traps of electrons in holes An increase in IPE concentration can therefore facilitate the discharge of the imaging member, which leads to lower residual potentials and $V_L$. For example, the charge generating layer can include about 5% to about 50% of the ether dopant IPE by weight of the TiOPc used in the charge generating layer.

The imaging members 100 can be negatively charged, when the charge generating layer 130 is situated between the undercoat layer 120, and the charge transport layer 140.

The undercoat layer 120, which can be referred to as a charge blocking layer and/or a blocking layer, can possess conductive characteristics. For example, the undercoat layer 120 can be a metal oxide-based layer, wherein the metal oxide can be selected from, for example, $TiO_2$, ZnO, $SnO_2$, $Al_2O_3$, $SiO_2$, $ZrO_2$, $In_2O_3$, $MoO_3$ and a complex oxide thereof, and mixtures and combinations thereof. The undercoat layer can also include, e.g., a silane. In various embodiments, the metal oxides can be $TiO_2$, either surface treated or untreated. For example, the metal oxide can be present in an amount of from about 5 to about 95 percent by weight of the undercoat layer 120.

In various embodiments, the undercoat layer 120 can include a binder component including, but not limited to, phenolic resins, phenoxy resins, epoxy resins, polyesters, polyacrylates, and the like. The binder component can present in an amount of from about 5 to about 95 weight percent based on the weight of the undercoat layer 120. In various embodiments, the undercoat layer 120 can be formed having a thickness of about 0.5 μm to about 30 μm.

The charge transport layer 140, such as a hole transport layer, can be formed over the charge generating layer 130 and can also include binder materials that are similar to that used for the charge generating layer 130. Examples of the binder materials for the charge transport layers 140 can include, e.g., polycarbonates, polyarylates, acrylate polymers, vinyl polymers, cellulose polymers, polyesters, polysiloxanes, polyamides, polyurethanes, poly(cyclo olefins), and epoxies, and random or alternating copolymers thereof. The charge transport layers 140 can also include, e.g., aryl amine molecules, and other known charge, especially hole transports. Examples of specific aryl amine molecules can include N,N'-diphenyl-N,N'-bis(3-methylphenyl)-1,1'-biphenyl-4,4'-diamine or N,N"-diphenyl-N,N"-bis(3-methylphenyl)-1,(1',4'),1"-triphenyl-4,4"-diamine as shown in formula II.

Formula II

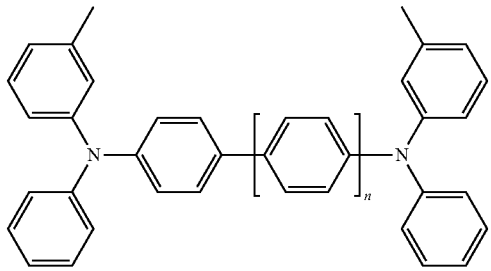

n = 1, 2

Other components or materials can be optionally incorporated into the charge transport layers 140. For example, hindered phenolic antioxidants or other charge transport layer molecules as known to one of ordinary skill in the art can be selected.

In various embodiments, the charge transport layer 140 can include one or more layers including a top charge transport layer and a bottom charge transport layer, for example, wherein the bottom layer is situated between the charge generating layer 130 and the top layer of the charge transport layer 140. In various embodiments, the charge transport layer 140 can have a thickness of from about 10 μm to about 50 μm.

In various embodiments, the optional overcoat layer (not illustrated in FIG. 1) can be deposited on the charge transport layer 140 and can include a polymeric binder material, a crosslinking agent, an acid catalyst and hole transport molecules similar to those present in the charge transport layer 140. Polymeric binder materials can include, but are not limited to, polyester polyol and polyacrylated polyol. Crosslinking agents, such as melamine crosslinking agents, can also be included in the overcoat layer. In various embodiments, an acid catalyst can be added to increase the rate of crosslinking between the components of the overcoat. The optional overcoat layer can have a thickness ranging from about 0.5 μm to about 15 μm.

In various embodiments, the supporting substrate 110 can be selected from a conductive metal substrate, for example, an aluminized or titanized polyethylene terephthalate or polyethylene. The substrate 110 for the imaging members 100 can be opaque or substantially transparent, and can include any suitable material having the requisite mechanical properties The substrate 110 can include, e.g., a layer of insulating material including inorganic or organic polymeric materials, such as poylarylate, or a layer of an organic or inorganic material having a semi-conductive surface layer, such as polysilane or the like.

The substrate 110 can be flexible, seamless, or rigid, and can have a number of many different configurations, such as, for example, a plate, a cylindrical drum, a scroll, an endless flexible belt, or the like. In various embodiments, the supporting substrate 110 can have a thickness of about 25 μm to about 3 mm. In various embodiments, the multilayered flexible imaging member 100 can include an anti-curl layer on the backside of the substrate support 110, opposite to the side of the electrically active layers (e.g., the undercoat layer 120), to render flatness of the desired photoconductive imaging member.

In various embodiments, the layered photoconductive imaging member disclosed herein can be selected for a number of different known imaging and/or printing processes including electrophotographic imaging processes. Processes of imaging (e.g., xerographic imaging and/or printing) can also be encompassed by the present teachings.

For example, various embodiments can include methods of imaging and printing with the disclosed imaging member. These methods can involve the formation of an electrostatic latent image on the imaging member, followed by developing the latent image with a toner composition including, for example, thermoplastic resin, colorant, such as pigment, charge additive, and surface additives; subsequently transferring the developed electrostatic image to a suitable substrate, e.g., an intermediate member or a final substrate such as a paper sheet; and/or permanently affixing the image thereto.

In a certain embodiment, an image forming apparatus for forming images on a recording medium can include, (1) an imaging member having a charge retentive surface to receive an electrostatic latent image thereon, wherein the imaging member can include a metal or metallized substrate; an undercoat layer containing, e.g., metal oxide; a charge generating layer including, e.g., a photoconductive pigment such as Titanyl phthalocyanine (TiOPc) and a dopant material such as a halide-containing compound dopant, an ether-type dopant, and/or a diiodo-type compound; a charge transport layer including charge transport materials dispersed therein and/or an optional overcoat layer; (2) a development member to apply a developer material to the charge-retentive surface to develop the electrostatic latent image to form a developed image on the charge-retentive surface; (3) a transfer member for transferring the developed image from the charge-retentive surface to another member or a copy substrate; and/or (4) a fusing member to fuse the developed image to the copy substrate.

EXAMPLES

Example 1

Preparation of a Charge Generating Pigment Dispersion

The charge generating pigment dispersion containing TiOPc was prepared by standard milling methods. TiOPc and BMS (i.e., polyvinyl butyral, supplied from Sekisui Chemicals Co., Ltd. in Japan) were milled together in a 60:40 weight ratio. The milled dispersion was separated into seven samples, and IPE was then added in 50, 25, 10, 5, 2.5, and 1 percent by weight of the TiOPc. A control was also prepared in which no IPE was added to the pigment TiOPc.

Example 2

Preparation of an Imaging Member

Imaging members were prepared having a 10 μm $TiO_2$-based undercoat layer (UCL), the charge generating layer (CGL) formed from the coating dispersion from Example 1 containing TiOPc pigment with and without IPE dopant, and finally a charge transport layer (CTL). CTL thickness was estimated using the dielectric thickness, which was determined from charging curves. Two different CTL thicknesses were used in order to more easily observe any trends in the electrical performance.

Example 3

Properties of the Prepared Imaging Member

Figure 2:
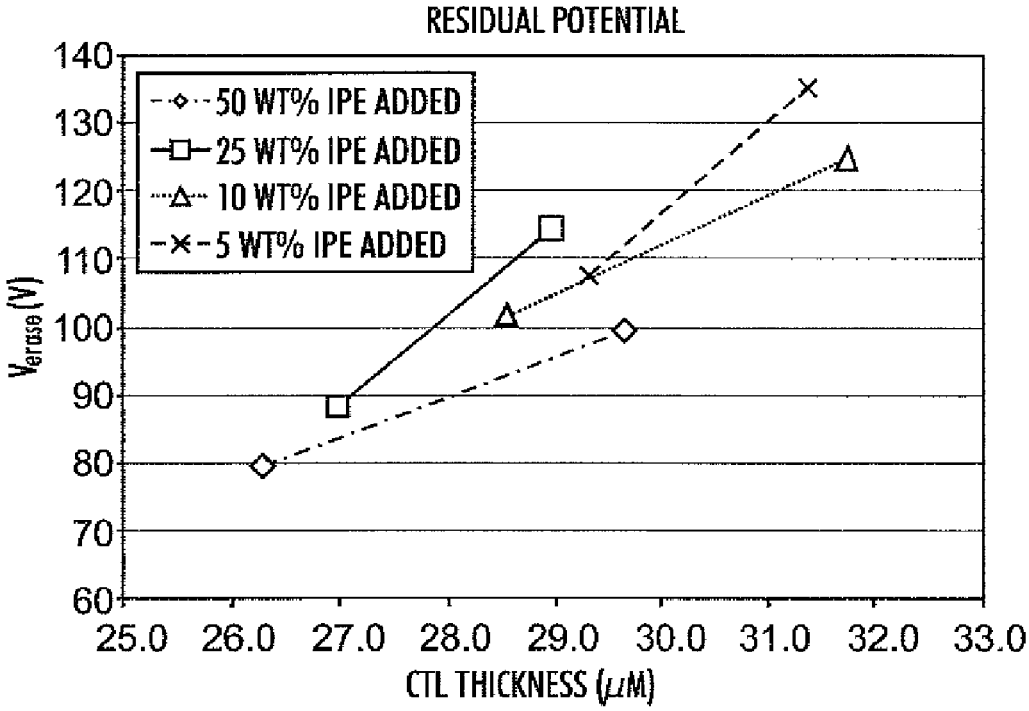
FIG. 2 depicts an exemplary result for the residual potentials of an exemplary imaging member in accordance with the present teachings.

Electrical scanning of these imaging members prepared from Example 2 showed that the addition of IPE dopant to the charge generating layer (CGL) had a significant impact on the residual potential ($V_{erase}$). FIG. 2 shows that, as the amount of IPE in the charge generating layer (CGL) was increased from about 5 to about 50 percent by weight, noticeable decreases in $V_{erase}$ can be obtained.

In addition, Table 1 shows that, concurrent with the decrease in $V_{erase}$, $V_L$ and dark decay were also observed to be slowly decreased as the weight percentage of the IPE dopant in the charge generating layer (CGL) increased. However, only subtle changes to the overall photosensitivity (−dv/dx) of the imaging member were observed. That is, desired photosensitivity can be maintained when the $V_{erase}$, $V_L$ and/or dark decay are controlled to be decreased.

TABLE 1

| wt % IPE added | CTL Thickness (μm) | $v_{erase}$ | $V_L$ | Dark Decay | −(dv/dx) |
|---|---|---|---|---|---|
| 0.0 | 29.4 | 98 | 124 | 29 | 528 |
| 1.0 | 29.7 | 96 | 121 | 26 | 532 |
| 2.5 | 29.3 | 92 | 117 | 26 | 535 |
| 5.0 | 29.3 | 91 | 116 | 25 | 544 |
| 10.0 | 25.5 | 87 | 112 | 21 | 545 |
| 25.0 | 27.6 | 77 | 100 | 20 | 516 |
| 50.0 | 26.9 | 74 | 95 | 17 | 508 |

Figure 3:
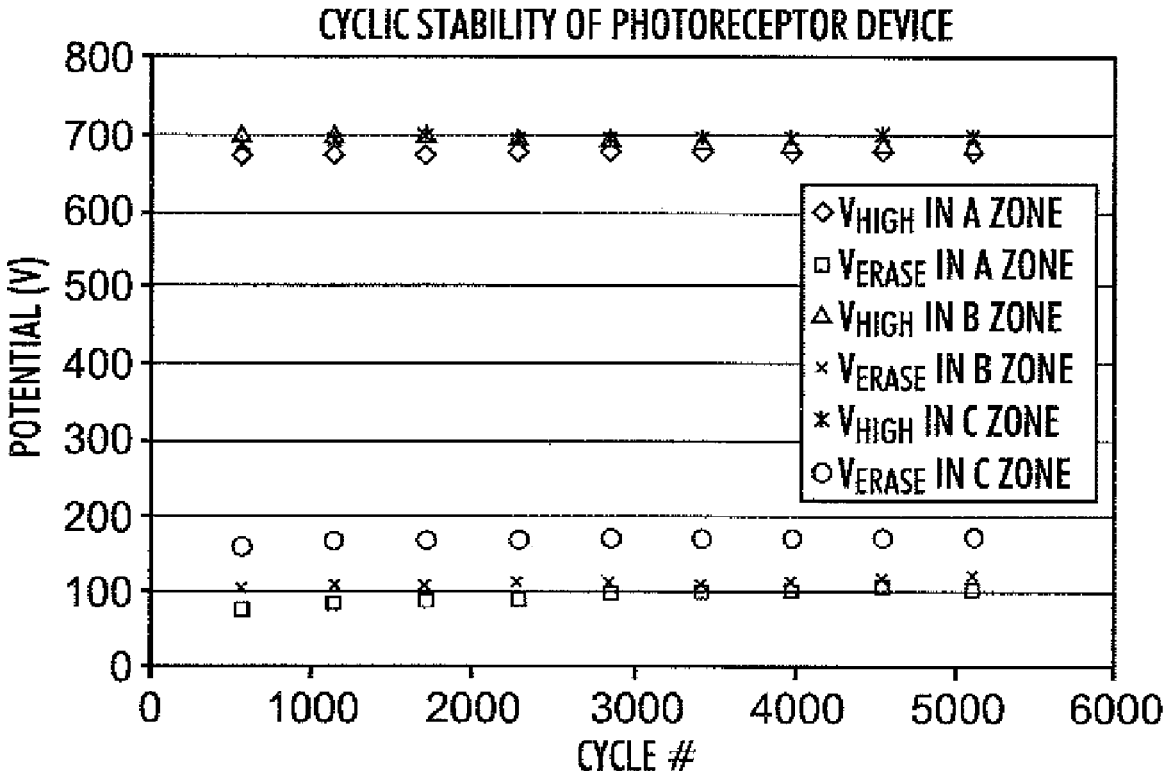
FIG. 3 depicts another exemplary result showing cyclic stability of an exemplary imaging member in accordance with the present teachings.

To test the cyclic stability, an imaging member formed to have 10 weight percent IPE dopant in the charge generating layer (CGL) was subjected to long-cycle tests in different environmental zones of, e.g., A (about 28° C., about 57% average relative humidity (ARH)), B (about 22° C., about 51% ARH), and C (about 9° C., about 20% ARH) zones FIG. 3 shows the stability of this imaging member in each of these zones. As shown in FIG. 3, the exemplary imaging member showed excellent cyclic stability in all three zones with little changes in $V_{high}$ and $V_{erase}$ over the course of several thousand cycles.

Additionally, Table 2 shows no significant changes in dark decay for the prepared imaging member, which is comparable with the imaging member having no IPE dopant in the charge generating layer (CGL).

TABLE 2

| Cycle # | A zone Dark Decay | B zone Dark Decay | C zone Dark Decay |
|---|---|---|---|
| 568 | 32 | 28 | 37 |
| 1136 | 35 | 29 | 39 |
| 1704 | 35 | 30 | 37 |
| 2272 | 35 | 31 | 35 |
| 2840 | 34 | 32 | 38 |
| 3408 | 35 | 33 | 37 |
| 3976 | 36 | 34 | 38 |
| 4544 | 36 | 34 | 37 |
| 5112 | 37 | 33 | 38 |

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An imaging member comprising:

a substrate;

an undercoat layer disposed over the substrate;

a charge generating layer disposed over the undercoat layer; the charge generating layer comprising a halide-containing dopant comprising one or more materials selected from the group consisting of 1,2-Bis(p-iodophenyl) ether, 1,3,5-tribromo-2-(4-bromophenoxy) benzene, 1,4-Bis(bromophenoxy)benzene, and combinations thereof; and at least one charge transport layer disposed over the charge generating layer.

2. The imaging member of claim 1, wherein the halide-containing dopant comprises an amount of from about 0.1 to about 75 weight percent based upon the weight of the charge generating layer.

3. The imaging member of claim 1, wherein the charge generating layer further comprises a photogenerating pigment selected from the group consisting of vanadyl phthalocyanine, metal phthalocyanines, metal-free phthalocyanine, hydroxygallium phthalocyanine, titanyl phthalocyanine, chlorogallium phthalocyanine, perylene, bis(benzimidazo)perylene and combinations thereof.

4. The imaging member of claim 3, wherein the multiple halide compound dopant is present in the charge generating layer in an amount of from about 5% to about 50% by weight of the photogenerating pigment.

5. The imaging member of claim 1, wherein the charge generating layer further comprises a binder material selected from the group consisting of poly(vinyl butyral), poly(vinyl butylene), poly(vinyl carbazole), polyesters, polycarbonates, poly(vinyl chloride), polyacrylates and methacrylates, copolymers of vinyl chloride and vinyl acetate, phenoxy resins, polyurethanes, poly(vinyl alcohol), polyacrylonitrile, polystyrene, and combinations thereof.

6. The imaging member of claim 1, wherein the charge generating layer has a thickness of about 0.1 μm to about 2 μm.

7. The imaging member of claim 1, wherein the charge generating layer comprises:

a diiodo compound dopant comprising 1, 2-Bis(p-iodophenyl) ether (IPE) present in an amount of about 0.1 percent to about 75 percent by weight of the charge generating layer;

a photogenerating pigment comprising titanyl phthalocyanines (TiOPc) present in an amount of about 5 percent to about 95 percent by weight of the charge generating layer; and a binder material comprising polyvinyl butylenes present in an amount of about 5 percent to about 95 percent by weight of the charge generating layer.

8. The imaging member of claim 1, wherein the undercoat layer comprises a metal oxide comprising $TiO_2$, ZnO, $SnO_2$, $Al_2O_3$, $SiO_2$, $ZrO_2$, $In_2O_3$, $MoO_3$or combinations thereof.

9. The imaging member of claim 8, wherein the metal oxide is present in an amount of from about 5 percent to about 95 percent by weight of the undercoat layer.

10. The imaging member of claim 1, wherein the undercoat layer comprises a binder selected from the group consisting of phenolic resins, phenoxy resins, epoxy resins, polyesters, polyacrylates and the like in an amount of about 5 percent to about 95 percent by weight of the undercoat layer.

11. The imaging member of claim 1, wherein the undercoat layer has a thickness of from about 0.5 μm to about 30 μm.

12. The imaging member of claim 1, wherein the at least one charge transport layer comprises a binder selected from the group consisting of polycarbonates, polyarylates, acrylate polymers, vinyl polymers, cellulose polymers, polyesters, polysiloxanes, polyamides, polyurethanes, poly(cyclo olefins), and epoxies in an amount of about 5 percent to about 95 percent by weight of the at least one charge transport layer.

13. The imaging member of claim 1, wherein the at least one charge transport layer has a thickness of from about 10 μm to about 50 μm.

14. The imaging member of claim 1, wherein the at least one charge transport layer has a number of layers from about 1 to about 3 layers.

15. The imaging member of claim 1, further comprising an optional overcoat layer disposed over the at least one charge transport layer.

16. The imaging member of claim 15, wherein the overcoat layer comprises one or more materials selected from the group consisting of polyester polyol, polyacrylated polyol, a crosslinking agent, an acid catalyst, and a hole transport molecule.

17. The imaging member of claim 15, wherein the overcoat layer has a thickness ranging from about 0.5 μm to about 15 μm.

18. An imaging member comprising:

a substrate;

an undercoat layer disposed on the substrate, the undercoating layer comprising metal oxide;

a charge generating layer disposed on the undercoat layer, the charge generating layer comprising a halide-containing dopant and a phthalocyanine photogenerating pigment, wherein the halide-containing dopant comprises one or more materials selected from the group consisting of 1,2-Bis(p-iodophenyl) ether, 1,3,5-tribromo-2-(4-bromophenoxy)benzene, 1,4-Bis(bromophenoxy)benzene, and combinations thereof;

at least one charge transport layer disposed on the charge generation layer; and an optional overcoat: layer disposed on the at least one charge transport layer.

* * * * *